US010468747B2

(12) United States Patent
Tchvertkin et al.

(10) Patent No.: US 10,468,747 B2
(45) Date of Patent: Nov. 5, 2019

(54) TUNABLE EXTERNAL ANTENNA BY USING DATA CONNECTOR OF PORTABLE DEVICES

(71) Applicant: MOTOROLA SOLUTIONS, INC., Chicago, IL (US)

(72) Inventors: Leonid Tchvertkin, Modi'in (IL); Haim Caspo, Petach Tikva (IL); Shuki Levy, Rishon Le Zion (IL); Arkady Subotsky, Be'er Sheva (IL)

(73) Assignee: MOTOROLA SOLUTIONS, INC., Chicago, IL (US)

( * ) Notice: Subject to any disclaimer, the term of this patent is extended or adjusted under 35 U.S.C. 154(b) by 317 days.

(21) Appl. No.: 15/394,503

(22) Filed: Dec. 29, 2016

(65) Prior Publication Data

US 2018/0191074 A1 Jul. 5, 2018

(51) Int. Cl.

| | |
|---|---|
| ***H01Q 5/50*** | (2015.01) |
| ***H01Q 1/24*** | (2006.01) |
| ***H01Q 1/44*** | (2006.01) |

(52) U.S. Cl.

CPC ..... *H01Q 1/24* (2013.01); *H01Q 1/44* (2013.01); *H01Q 5/50* (2015.01)

(58) Field of Classification Search

CPC .. H01Q 1/24; H01Q 5/50; H01Q 1/44; H01Q 1/242; H01Q 1/243; H01Q 1/2275; H01Q 1/244

See application file for complete search history.

(56) References Cited

U.S. PATENT DOCUMENTS

| | | | | |
|---|---|---|---|---|
| 8,818,455 | B2 | 8/2014 | Harrison et al. | |
| 2012/0189068 | A1 | 7/2012 | Korner | |
| 2013/0237283 | A1* | 9/2013 | Harrison | H04M 1/0274 455/557 |
| 2014/0184469 | A1 | 7/2014 | Yoshino et al. | |
| 2017/0093552 | A1* | 3/2017 | Zhang | H04B 7/04 |

FOREIGN PATENT DOCUMENTS

| | | |
|---|---|---|
| EP | 2192531 | 6/2010 |
| JP | 2014183512 | 9/2014 |

* cited by examiner

*Primary Examiner* — Hai V Tran
*Assistant Examiner* — Awat M Salih
(74) *Attorney, Agent, or Firm* — Michael Best & Friedrich LLP

(57) ABSTRACT

A method and apparatus for operating a tunable accessory connected to a portable communications device. The method includes detecting, using an electronic processor, that a network signal is below a threshold and connecting, using a first switch connected to the electronic processor and a data connector port of a portable communications device, data signals received from the data connector port to radio frequency frontend. The method also includes determining, using an accessory electronic processor of the tunable accessory, a radio frequency band requirement of the portable communications device and tuning, using a matching tuning network controller of the tunable accessory, an external antenna of the tunable accessory. The method further includes connecting, using a second switch connected to the accessory electronic processor, a data connector output to the data connector port to external antenna signals received from the matching tuning network controller.

20 Claims, 5 Drawing Sheets

TUNABLE EXTERNAL ANTENNA BY USING DATA CONNECTOR OF PORTABLE DEVICES

BACKGROUND OF THE INVENTION

Portable communications devices, such as two-way radios, mobile telephones, and the like, use an internal antenna to send and receive communications. These internal antennas may not always perform as desired, particularly in areas with poor network or cell coverage. Users of portable communications devices sometimes use external antennas that may be connected to the portable communications devices to improve performance.

BRIEF DESCRIPTION OF THE SEVERAL VIEWS OF THE DRAWINGS

The accompanying figures, where like reference numerals refer to identical or functionally similar elements throughout the separate views, together with the detailed description below, are incorporated in and form part of the specification, and serve to further illustrate embodiments of concepts that include the claimed invention, and explain various principles and advantages of those embodiments.

Figure 1:
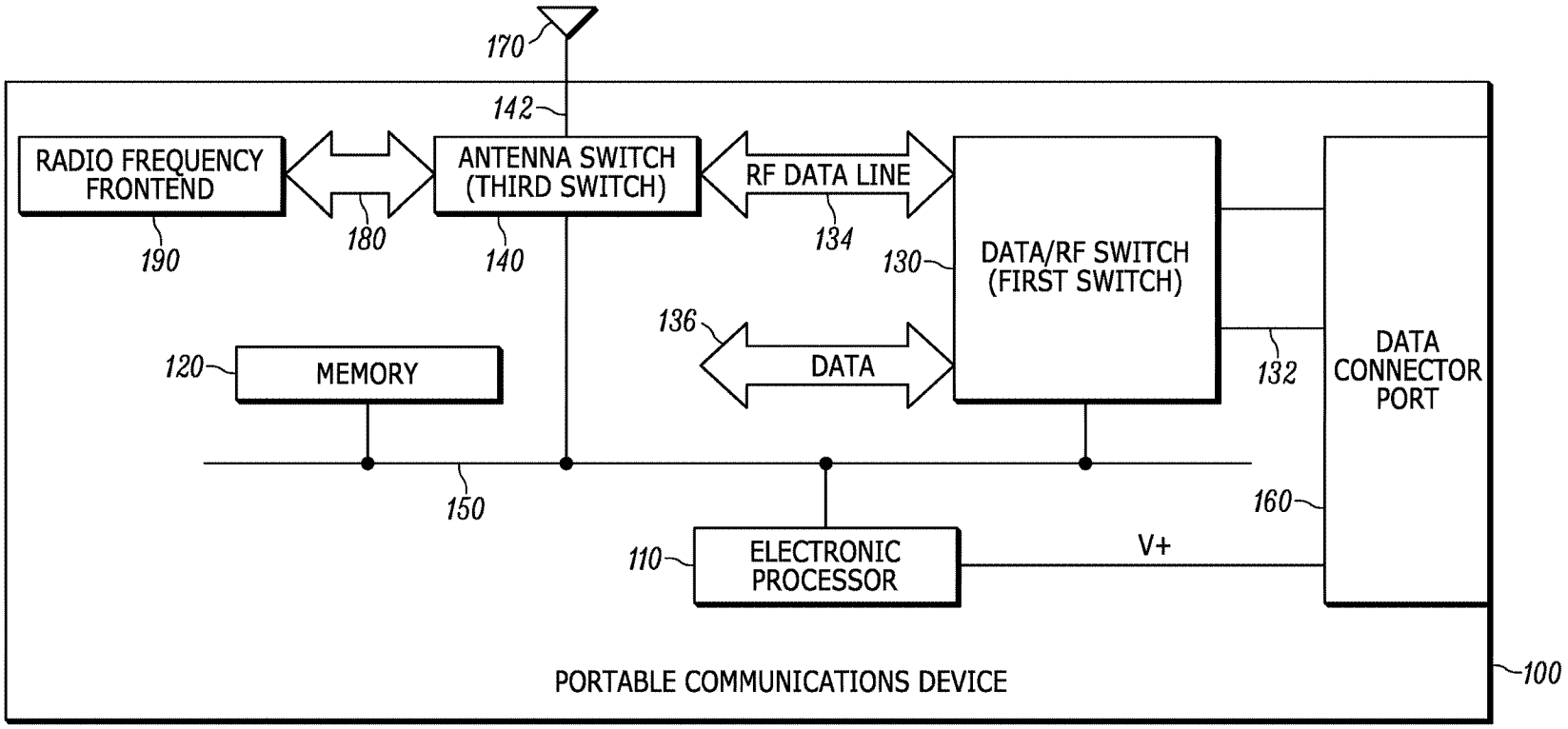
FIG. 1 is a diagram of a portable communications device in accordance with some embodiments.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

The apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

DETAILED DESCRIPTION OF THE INVENTION

While external antennas have been used with portable communications devices, external antennas may not be tunable and using them may decrease the efficiency of a portable communications device.

One embodiment provides a system including a portable communications device. The portable communications device includes an electronic processor and a data connector port connected to the electronic processor. The portable communications device also includes a first switch connected to the electronic processor and the data connector port. The first switch is configured to switch data signals received from the data connector port between a radio frequency frontend and a data input of the portable communications device. The system also includes a tunable accessory configured to be connected to the portable communications device via the data connector port. The tunable accessory includes an accessory electronic processor and a matching tuning network controller connected to the accessory electronic processor and an external antenna. The matching tuning network controller is configured to tune the external antenna based on an input received from the accessory electronic processor. The tunable accessory also includes a second switch connected to the accessory electronic processor and the data connector port. The second switch switches a data connector output to the data connector port between data signals from the accessory electronic processor and external antenna signals from the matching tuning network controller.

Another embodiment provides a tunable accessory connectable to a data connector port of a portable communications device. In one example, the tunable accessory includes an accessory electronic processor and a matching tuning network controller connected to the accessory electronic processor and an external antenna. The external antenna is configured to tune the external antenna based on an input received from the accessory electronic processor. The tunable accessory also includes a switch connected to the accessory electronic processor. The switch is configured to switch a data connector output to the data connector port between data signals from the accessory electronic processor and external antenna signals from the matching tuning network controller.

Another embodiment provides a method for operating a tunable accessory connected to a portable communications device. The method includes detecting, using an electronic processor, that the tunable accessory is connected to the portable communications device and connecting, using a first switch connected to the electronic processor and a data connector port of a portable communications device, data signals received from the data connector port to radio frequency frontend. The method also includes determining, using an accessory electronic processor of the tunable accessory, a radio frequency band requirement of the portable communications device and tuning, using a matching tuning network controller of the tunable accessory, an external antenna of the tunable accessory. The method further includes connecting, using a second switch connected to the accessory electronic processor, a data connector output to the data connector port to external antenna signals received from the matching tuning network controller.

FIG. 1 is a diagram of one embodiment of a portable communications device 100. The portable communications device 100 may be, for example, a two-way radio, a mobile device, a tablet computer, and the like. In the example illustrated, the portable communications device 100 includes an electronic processor 110, a memory 120, a data/RF switch 130, and an antenna switch 140. The electronic processor 110 communicates with the memory 120, the data/RF switch 130, and the antenna switch 140 over one or more control and/or data buses (for example, communication buses 150). The portable communications device 100 also includes a data connector port 160 to connect the portable communications device 100 to external devices. FIG. 1 illustrates only one exemplary embodiment of a portable communications device 100. The portable communications device 100 may include more or fewer components and may perform functions other than those explicitly described herein.

In some embodiments, the electronic processor 110 is implemented as a microprocessor with separate memory, such as the memory 120. In other embodiments, the electronic processor 110 may be implemented as a microcontroller (with memory 120 on the same chip). In other embodiments, the electronic processor 110 may be implemented using multiple processors. In addition, the electronic processor 110 may be implemented partially or entirely as, for example, a field-programmable gate array (FPGA), and application specific integrated circuit (ASIC), and the like and the memory 120 may not be needed or be modified accordingly. In the example illustrated, the memory 120 includes non-transitory, computer-readable memory that stores instructions that are received and executed by the electronic processor 110 to carry out functionality of the portable communications device 100 described herein. The memory 120 may include, for example, a program storage area and a data storage area. The program storage area and the data storage area may include combinations of different types of memory, such as read-only memory and random-access memory.

The data/RF switch 130 (for example, a first switch) has a port that receives and sends data connector signals 132 to and from the data connector port 160. A radio frequency (RF) data lines 134 is provided between the data/RF switch 130 and the antenna switch 140. The data/RF switch 130 also connects the data signals 136 to the data connector signals 132 of the data connector port 160. The data signals 136 may be provided to or received from, for example, a data port of the portable communications device 100. The data/RF switch 130 connects the data connector signals 132 of the data connector port 160 to one of the radio frequency data lines 134 and the data signals 136 based on a control signal received from the electronic processor 110. The data/RF switch 130 may be, for example, a de-multiplexor, an analog switch, or the like.

In some embodiments, when the electronic processor 110 determines that an external antenna is connected to the portable communications device 100 at the data connector port 160, the electronic processor 110 controls the data/RF switch 130 to connect the data connector signals 132 from data connector port 160 to the radio frequency data lines 134. When the electronic processor 110 determines that an external data device, such as, an external memory, a charger, or the like is connected to the portable communications device 100 at the data connector port 160, the electronic processor 110 controls the data/RF switch 130 to connect the data connector signals 132 from the data connector port 160 to the data signals 136.

The antenna switch 140 (for example, a third switch) receives data connector signals 132 from an external antenna through radio frequency data lines 134 from the data/RF switch 130 and antenna signals 142 from the internal antenna 170. In some embodiments, a matching tuning network controller may be connected between the antenna switch 140 and the internal antenna 170 to tune the internal antenna 170 to a desired frequency or bandwidth based on the requirements of the portable communications device 100. The outputs of the antenna switch 140, including frontend signals 180, are connected to a radio frequency (RF) frontend 190. The antenna switch 140 connects the frontend signals 180 (that is, an input to the radio frequency frontend 190) to the internal antenna 170, or an external antenna (through the data/RF switch 130) based on a control signal received from the electronic processor 110. The antenna switch 140 may include, for example, one or more multiplexor/de-multiplexors and/or analog switches connected back-to-back.

In some embodiments, when the electronic processor 110 determines that an external antenna is connected to the portable communications device 100 at the data connector port 160, the electronic processor 110 controls the antenna switch 140 to connect the external antenna to the radio frequency frontend 190. When so controlled, the antenna switch 140 provides data connector signals 132 from the external antenna to the radio frequency frontend 190. When the electronic processor 110 determines than there is no external antenna connected to the portable communications device 100, the electronic processor 110 controls the antenna switch 140 to connect the antenna signals 142 to the radio frequency frontend 190. In some embodiments, the antenna switch 140 may provide signals from both the internal antenna 170 and the external antenna to the radio frequency frontend 190 in order to implement an antenna diversity scheme.

In some embodiments, the data/RF switch 130 and the antenna switch 140 may be implemented as a single switch to connect the data connector port 160 and/or the internal antenna 170 to a data input of the portable communications device 100 and the radio frequency frontend 190.

Figure 2:
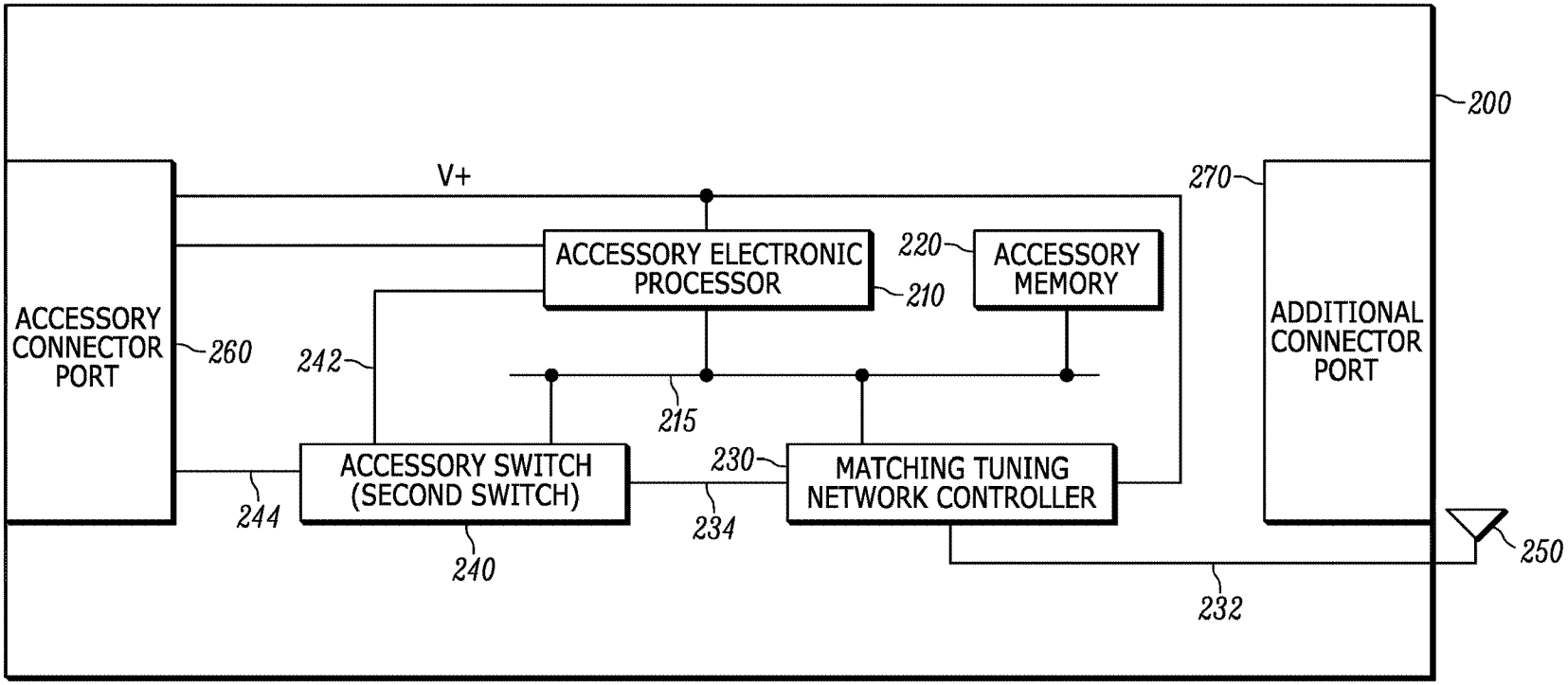
FIG. 2 is a diagram of a tunable accessory in accordance with some embodiments.

FIG. 2 is a diagram of one embodiment of a tunable accessory 200. The tunable accessory 200 may be, for example, an external tunable antenna, a universal serial bus (USB) device, and the like. The tunable accessory 200 is configured to be connected to the portable communications device 100 via the data connector port 160. In the example illustrated, the tunable accessory 200 includes an accessory electronic processor 210, an accessory memory 220, a matching tuning network controller 230, and an accessory switch 240. The accessory electronic processor 210 communicates with the accessory memory 220, the matching tuning network controller 230, and the accessory switch 240 over one or more control and/or data buses (for example, a device communication bus 215). FIG. 2 illustrates only one exemplary embodiment of a tunable accessory 200. The tunable accessory 200 may include more or fewer components and may perform functions other than those explicitly described herein.

The accessory electronic processor 210 may be implemented in various ways including ways that are similar to those described above with respect to the electronic processor 110. Likewise, the accessory memory 220 may be implemented in various ways including ways that are similar to those described with respect to the memory 120. The accessory memory 220 may store instructions that are received and executed by the accessory electronic processor 210 to carry out the functionality described herein.

The matching tuning network controller 230 has a port coupled to an external antenna 250 to receive and/or send radio frequency signals 232 to/from the external antenna 250. Another port of the matching tuning network controller 230 is coupled to the accessory switch 240. The matching tuning network controller 230 may include receiving and/or transmitting circuits connected to the external antenna 250. The matching tuning network controller 230 may also include an analog-to-digital converter to convert analog signals received at the external antenna 250 to digital signals for use by the tunable accessory 200. The matching tuning network controller 230 may further include digital-to analog converter to convert digital signals from the tunable accessory 200 to be transmitted by the external antenna 250. The matching tuning network controller 230 adjusts the impedance of the receiving and/or transmitting circuits connected to the external antenna 250 to adjust a band, frequency, and/or bandwidth of the external antenna 250. The accessory electronic processor 210 provides a control signal to the matching tuning network controller 230 to adjust the bands, frequencies and/or bandwidths of the external antenna 250. As such, the accessory electronic processor 210 tunes the external antenna 250 to desired bands, frequencies or bandwidths. In some embodiments, active elements such as low-noise amplifiers, power amplifiers, or the like may be connected to the external antenna 250. The accessory electronic processor 210 may control these active elements using the matching tuning network controller 230 to enable or disable the active elements or to adjust the gain of the active elements.

The accessory switch 240 (for example, a switch or a second switch) has a port connected to the matching tuning network controller 230 to receive and/or transmit external antenna signals 234. The accessory switch 240 also receives and/or transmits device data signals 242 from the accessory electronic processor 210. In some embodiments, the accessory switch 240 may include additional ports to receive and/or transmit data to and from the accessory memory 220, other components of the tunable accessory 200, external devices connected to the tunable accessory 200, or the like. The accessory switch 240 provides and receives data connector signals 244 to and from an accessory data connector port 260. The accessory switch 240 connects the data connector signals 244 to one of the external antenna signals 234 of the external antenna 250 and the device data signals 242 received from the accessory electronic processor 210 based on a control signal received from the accessory electronic processor 210.

In some embodiments, the tunable accessory 200 may include an additional connector port 270 to connect the tunable accessory 200 to an external device. The external device may be, for example, a charger, a memory device, and the like. In these embodiments, an input of the accessory switch 240 may be connected to the additional connector port 270 to receive data and/or charging current from the external device.

Figure 3:
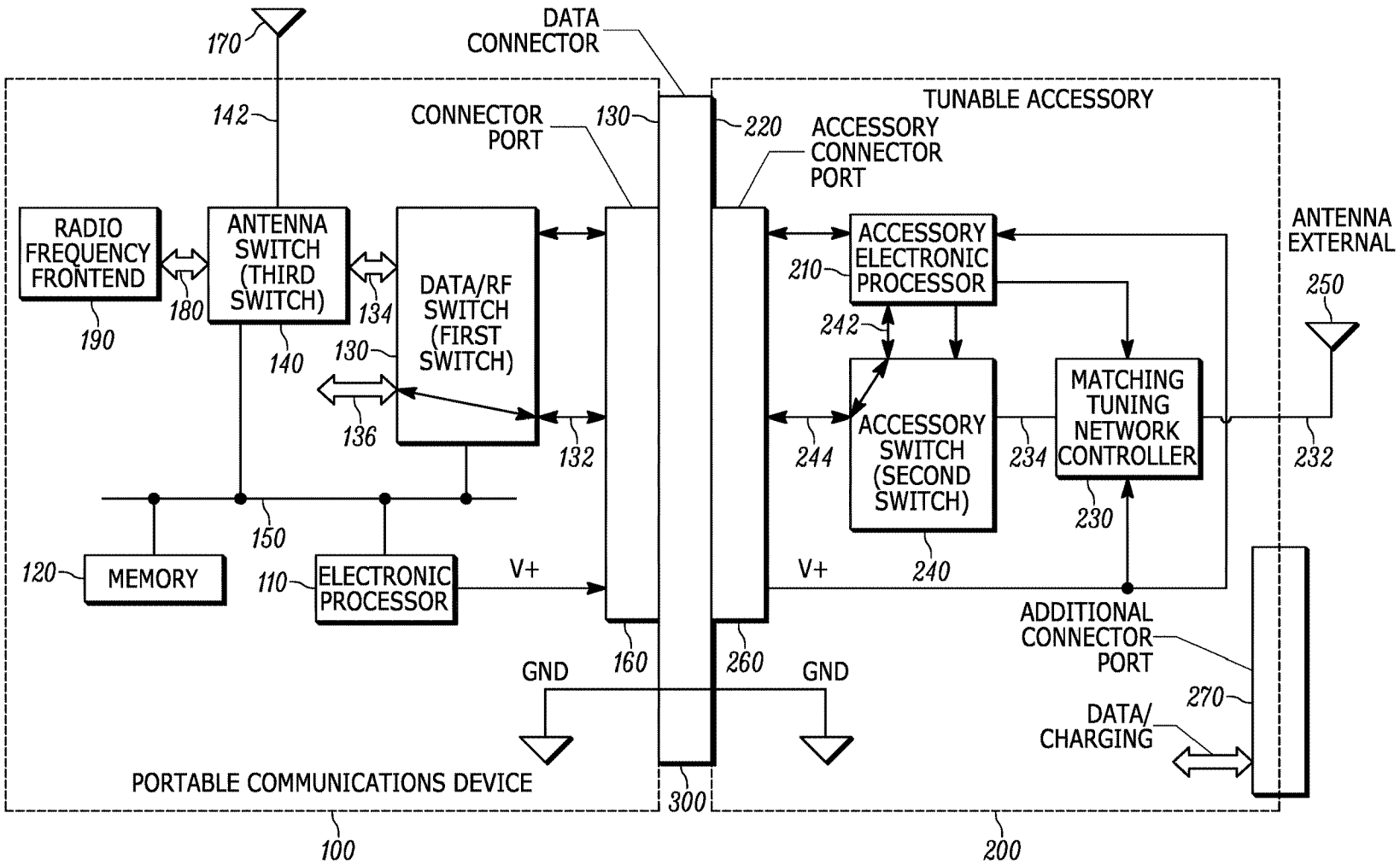
FIG. 3 is a diagram of a connection between the portable communications device of FIG. 1 and the tunable accessory of FIG. 2 in accordance with some embodiments.
Figure 4:
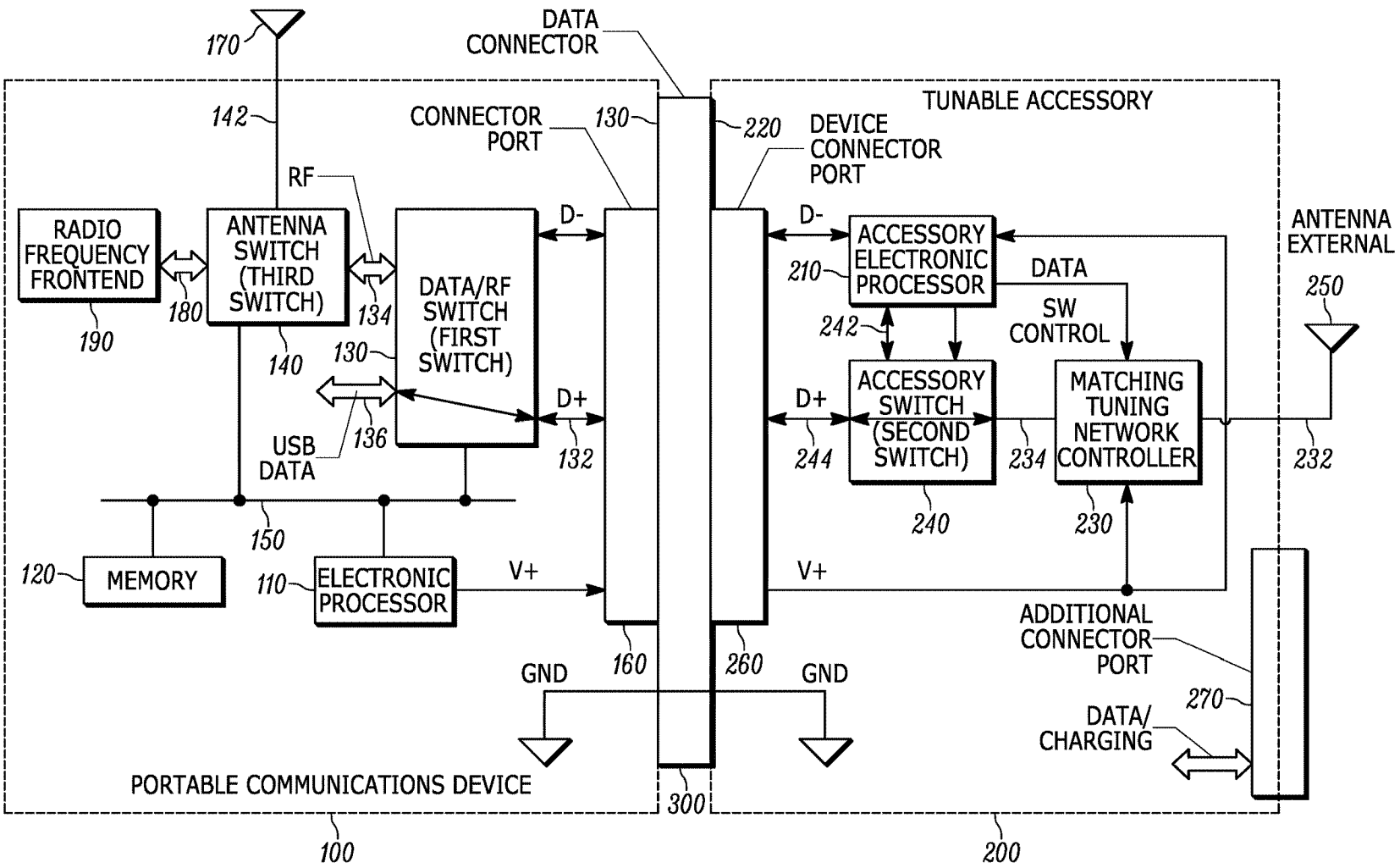
FIG. 4 is a diagram of a connection between the portable communications device of FIG. 1 and the tunable accessory of FIG. 2 in accordance with some embodiments.

FIGS. 3-4 illustrate a connection between the portable communications device 100 and the tunable accessory 200. In the example illustrated, the portable communications device 100 and the tunable accessory 200 are coupled by a data connector 300. In the illustrated embodiment, the data connector 300 connects the data connector port 160 of the portable communications device 100 and the accessory data connector port 260 of the tunable accessory 200. The data connector 300 may be for example, a universal serial bus (USB™) connector, Thunderbolt™ connector, or the like. The portable communications device 100 receives both data and antenna signals from the tunable accessory 200. The electronic processor 110 provides operating power to the components of the tunable accessory 200. In some embodiments, the electronic processor 110 may provide control signals directly to the matching tuning network controller 230 and the accessory switch 240. In addition, the electronic processor 110 may also communicate with the accessory electronic processor 210 to exchange control and/or data signals.

FIG. 3 illustrates the connections of the switches (the data/RF switch 130, the antenna switch 140, and the accessory switch 240) when the portable communications device 100 and the tunable accessory 200 are configured to exchange data signals. In some embodiments, when the electronic processor 110 determines that the portable communications device 100 receives adequate network signal (that is, the network signal is above a power or quality threshold) from the internal antenna 170, the electronic processor 110 and the accessory electronic processor 210 control the data/RF switch 130 and the accessory switch 240 to exchange data between the portable communications device 100 and the tunable accessory 200. The accessory electronic processor 210 controls the accessory switch 240 to connect device data signals 242 to the data connector signals 244. The electronic processor 110 controls the data/RF switch 130 to connect data connector signals 132 to data signals 136. In addition, the electronic processor 110 controls the antenna switch 140 to connect the internal antenna 170 to the radio frequency frontend 190.

FIG. 4 illustrates the connections of the switches (the data/RF switch 130, the antenna switch 140, and the accessory switch 240) when the portable communications device 100 and the tunable accessory 200 are configured to exchange antenna signals received or transmitted from the external antenna 250. The accessory electronic processor 210 controls the accessory switch 240 to connect external antenna signals 234 to the data connector signals 244. The electronic processor 110 controls the data/RF switch 130 to connect the data connector signals 132 to the radio frequency data lines 134. In addition, the electronic processor 110 controls the antenna switch 140 to connect the radio frequency data lines 134 to the radio frequency frontend 190.

As described above, in some embodiments, the antenna switch 140 may connect both the internal antenna 170 and the external antenna 250 to the radio frequency frontend 190. In these embodiments, the internal antenna 170 and external antenna 250 may be used to implement a diversity scheme. In the diversity scheme, the internal antenna 170 and the external antenna 250 may be used simultaneously to receive and transmit signals. For example, the electronic processor 110 may use the internal antenna 170 as the main antenna and the external antenna 250 as the diversity antenna or vice versa. In some embodiments, rather than the electronic processor 110 and the accessory electronic processor 210 automatically controlling the data/RF switch 130, the antenna switch 140, and the accessory switch 240 one or more of these switches may be controlled manually, for example, based on an input received from a user of the portable communications device 100.

Figure 5:
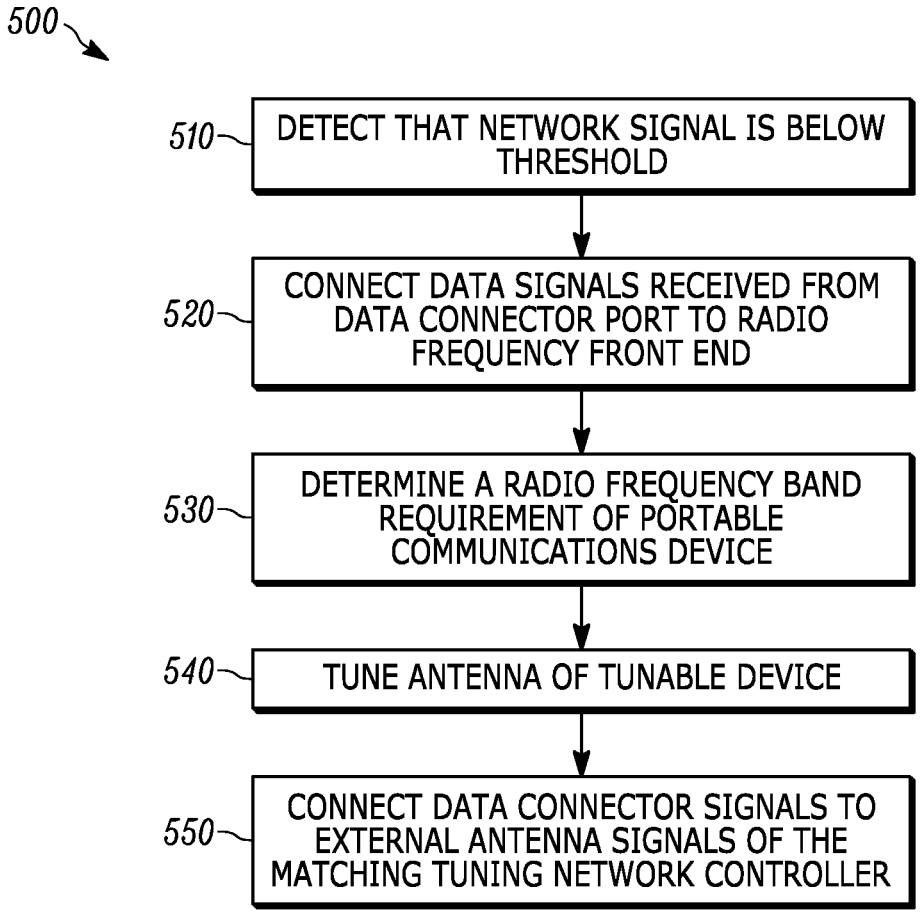
FIG. 5 is a flowchart of a method for operating the tunable accessory of FIG. 2 connected to the portable communications device of FIG. 1.

FIG. 5 is a flowchart illustrating one example method 500 for operating the tunable accessory 200 connected to the portable communications device 100. As illustrated in FIG. 5, the method 500 includes detecting, with the electronic processor 110, that that the tunable accessory is connected to the portable communications device (at block 510). The electronic processor 110 may also detect that the tunable accessory includes an external antenna 250 that may be used in situations where there is poor network coverage. The method 500 also includes connecting, with the data/RF switch 130 using the electronic processor 110, data connector signals 132 received from the data connector port 160 to the radio frequency frontend 190 (at block 520). The electronic processor 110 controls the data/RF switch 130 to connect the external antenna signals 234 received from the external antenna 250 (as data connector signals 132) to the radio frequency data lines 134 provided to the antenna switch 140. The antenna switch 140 in-turn connects the radio frequency data lines 134 from the data/RF switch 130 to the radio frequency frontend 190.

The method 500 further includes determining, with the accessory electronic processor 210, a radio frequency band requirement of the portable communications device 100 (at block 530). The portable communications device 100 may operate at different bandwidth based on the different requirements of the portable communications device 100. For example, the portable communications device 100 may operate at a first bandwidth for a global positioning system (GPS) operation and may operate at a second bandwidth for a voice communication operation. In some embodiments, the electronic processor 110 determines the radio frequency bandwidth requirements of the portable communications device 100 and communicates the requirements to the accessory electronic processor 210.

The method 500 also includes tuning, with the matching tuning network controller 230, the external antenna 250 of the tunable accessory 200 (at block 540). Once the bandwidth requirements of the portable communications device 100 are determined, the matching tuning network controller 230 adjusts the impedance of the receiving and/or transmitting circuits connected to the external antenna 250. As a consequence, the external antenna 250 may receive and transmit signals at the desired bandwidth.

After tuning, the method 500 includes connecting, using the accessory electronic processor 210 with the accessory switch 240, the data connector signals 244 to external antenna signals 234 of the matching tuning network controller 230 (at block 550). The accessory electronic processor 210 controls the accessory switch 240 to connect the external antenna signals 234 of the external antenna 250 to the accessory data connector port 260.

One advantage of the above techniques is that the portable communications device 100 may receive radio frequency signals, data signals, or charge current from the tunable accessory 200. In addition, the signal gain of the portable communications device 100 is improved by connecting the external antenna 250 through the tunable accessory 200. Another advantage of the above techniques is that antenna isolation is improved. Improved antenna isolation improves intermodulation immunity and enhances performance when using multiple-frequency protocols, for example, carrier aggregation, simultaneous voice and long term evolution ("SV LTE), and the like.

In the foregoing specification, specific embodiments have been described. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of present teachings.

The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," or "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

It will be appreciated that some embodiments may be comprised of one or more generic or specialized processors (or "processing devices") such as microprocessors, digital signal processors, customized processors and field programmable gate arrays (FPGAs) and unique stored program instructions (including both software and firmware) that control the one or more processors to implement, in conjunction with certain non-processor circuits, some, most, or all of the functions of the method and/or apparatus described herein. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used.

Moreover, an embodiment can be implemented as a computer-readable storage medium having computer readable code stored thereon for programming a computer (e.g., comprising a processor) to perform a method as described and claimed herein. Examples of such computer-readable storage mediums include, but are not limited to, a hard disk, a CD-ROM, an optical storage device, a magnetic storage device, a ROM (Read Only Memory), a PROM (Programmable Read Only Memory), an EPROM (Erasable Programmable Read Only Memory), an EEPROM (Electrically Erasable Programmable Read Only Memory) and a Flash memory. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

We claim:

1. A system comprising:

a portable communications device including:

an electronic processor, a data connector port connected to the electronic processor, and a first switch connected to the electronic processor and the data connector port, the first switch configured to switch data signals received from the data connector port between a radio frequency frontend and a data input of the portable communications device, and a tunable accessory configured to be connected to the portable communications device via the data connector port, the tunable accessory including:

an accessory electronic processor, a matching tuning network controller connected to the accessory electronic processor and an external antenna, the matching tuning network controller configured to tune the external antenna based on an input received from the accessory electronic processor, and a second switch connected to the accessory electronic processor and the data connector port, where the second switch switches a data connector output to the data connector port between data signals from the accessory electronic processor and external antenna signals from the matching tuning network controller.

2. The system of claim 1, wherein the portable communications device further includes:

a third switch connected to the radio frequency frontend, the first switch, and an internal antenna and configured to switch an input to the radio frequency frontend between the first switch and the internal antenna.

3. The system of claim 1, further comprising an internal antenna, wherein the electronic processor is configured to use the external antenna as a main antenna.

4. The system of claim 3, wherein the electronic processor is configured to use the internal antenna as a diversity antenna.

5. The system of claim 4, wherein the electronic processor is configured to use the internal antenna as the diversity antenna and simultaneously use the external antenna the main antenna.

6. The system of claim 1, further comprising an internal antenna, wherein the electronic processor is configured to use the external antenna as a diversity antenna and simultaneously use the internal antenna as a main antenna.

7. The system of claim 1, wherein the data connector port comprises a universal serial bus (USB) port.

8. A tunable accessory connectable to a data connector port of a portable communications device, comprising:

an accessory electronic processor, a matching tuning network controller connected to the accessory electronic processor and an external antenna and configured to tune the external antenna based on an input received from the accessory electronic processor, and a switch connected to the accessory electronic processor and configured to switch a data connector output to the data connector port between data signals from the accessory electronic processor and external antenna signals from the matching tuning network controller.

9. The tunable accessory of claim 8, wherein the accessory electronic processor is configured to use the external antenna as a main antenna.

10. The tunable accessory of claim 8, wherein the accessory electronic processor is configured to use the external antenna as a diversity antenna.

11. The tunable accessory of claim 8, wherein the data connector port comprises a universal serial bus (USB) port.

12. A method for operating a tunable accessory connected to a portable communications device, the method comprising:

detecting, using an electronic processor, that the tunable accessory is connected to the portable communications device;

connecting, using a first switch connected to the electronic processor and a data connector port of the portable communications device, data signals received from the data connector port to radio frequency frontend;

determining, using an accessory electronic processor of the tunable accessory, a radio frequency band requirement of the portable communications device;

tuning, using a matching tuning network controller of the tunable accessory, an external antenna of the tunable accessory; and connecting, using a second switch connected to the accessory electronic processor, a data connector output to the data connector port to external antenna signals received from the matching tuning network controller.

13. The method of claim 12, further comprising:

connecting, using a third switch connected to the radio frequency frontend, an internal antenna, and the first switch, an input to the radio frequency frontend to the first switch.

14. The method of claim 13, further comprising:

detecting, using the electronic processor, that the network signal is above a threshold;

connecting, using the first switch, data signals received from the data connector port to a data input of the portable communications device; and connecting, using the second switch, the data connector output to the data connector port to the accessory electronic processor.

15. The method of claim 14, further comprising:

connecting, using the third switch, the input to the radio frequency frontend to the internal antenna of the portable communications device.

16. The method of claim 12, further comprising using the external antenna as a main antenna.

17. The method of claim 16, further comprising using an internal antenna of the portable communications device as a diversity antenna.

18. The method of claim 17, further comprising using the internal antenna as the diversity antenna and simultaneously using the external antenna as the main antenna.

19. The method of claim 12, further comprising using the external antenna as a diversity antenna and simultaneously using an internal antenna of the portable communications device as a main antenna.

20. The method of claim 12, wherein the data connector port comprises a universal serial bus (USB) port.

* * * * *